114-253 SR
5/14/85 XR 4,516,517

United States Patent [19]

Ayers

[11] Patent Number: 4,516,517

[45] Date of Patent: May 14, 1985

[54] FLOAT RECOVERY SYSTEM

[75] Inventor: Ray R. Ayers, Houston, Tex.

[73] Assignee: Shell Oil Company, Houston, Tex.

[21] Appl. No.: 516,158

[22] Filed: Jul. 21, 1983

[51] Int. Cl.[3] ..... B63C 7/16

[52] U.S. Cl. ..... 114/51; 114/244; 114/246; 114/253

[58] Field of Search ..... 114/242, 243, 244, 245, 114/253, 254, 365, 366, 377, 378, 379, 380, 47, 48, 49, 51, 144 B, 268, 239, 246, 259, 322; 414/137, 138; 212/193; 367/16, 20, 23; 181/115, 118, 120; 405/166; 73/170 A; 244/1 TD

[56] References Cited

U.S. PATENT DOCUMENTS

| | | | |
|---|---|---|---|
| 621,640 | 3/1899 | Drzewiecki | 114/239 |
| 3,159,806 | 12/1964 | Piasecki | 244/1 TD |
| 3,744,021 | 7/1973 | Todd | 367/23 |
| 3,760,762 | 9/1973 | Spangberg | 114/246 |
| 3,807,335 | 4/1974 | Talkington | 114/259 |
| 4,323,989 | 4/1982 | Huckabee et al. | 367/17 |

FOREIGN PATENT DOCUMENTS

| | | | |
|---|---|---|---|
| 135390 | 10/1981 | Japan | 114/268 |
| 1231486 | 5/1971 | United Kingdom | 114/244 |
| 908653 | 3/1982 | U.S.S.R. | 114/268 |

*Primary Examiner*—Trygve M. Blix
*Assistant Examiner*—Thomas J. Brahan

[57] ABSTRACT

A method and apparatus are provided for recovering a towed body to onboard a towing ship while the towing ship is underway. A saddle is employed in cooperation with a rudder to engage one end of the towed body and, subsequent to engagement, the saddle means is slid forward to engage the opposite end of the towed body.

14 Claims, 7 Drawing Figures

FIG.1
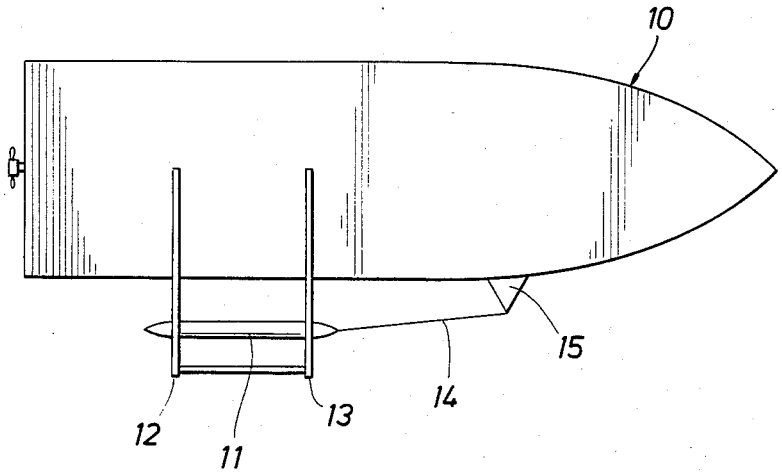
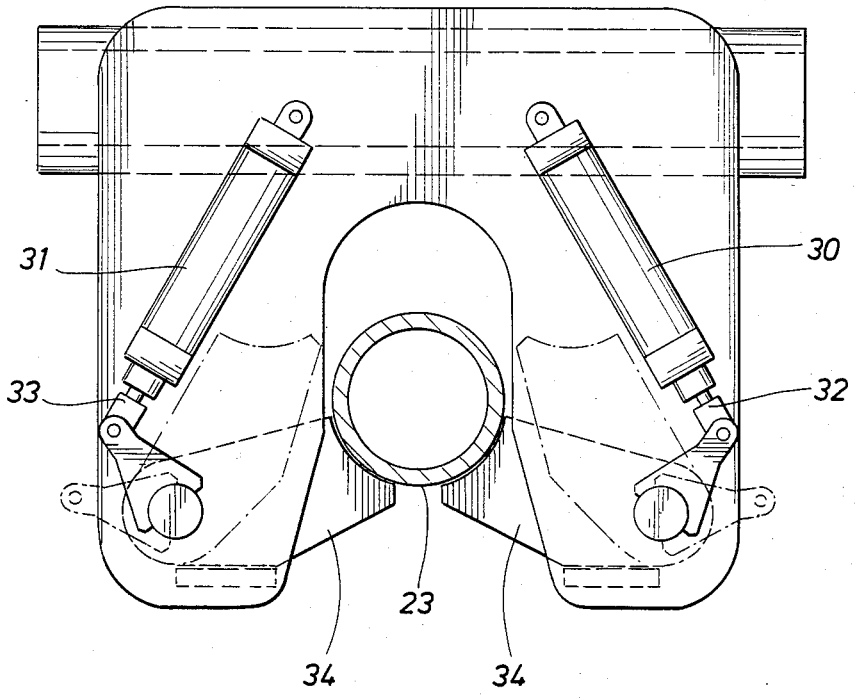
FIG.3

FLOAT RECOVERY SYSTEM

BACKGROUND OF THE INVENTION

It is difficult to attach lifting lines to a towed body while the towed body is alongside a "mother" ship (see FIG. 1). It is considered quite difficult and dangerous for men to reach over the side with grapples and try to put lines on the towed body, particularly when the mother ship is much larger than the towed body.

One conventional way of attaching lines to the towed body is to leave "pigtails" trailing from the towed body. These pigtails are captured using poles and brought onboard the mother ship for attachment to lift lines. However, this procedure may be very cumbersome for recovering, for example, from a 300-foot long mother ship, a seismic subarray which may be up to 60 feet long, weigh up to 25,000 pounds, and have attached gear such as seismic guns and umbilical cables which are subject to entanglement. Accordingly, considering both the size, unwieldy dimensions and motion of a seismic subarray, it is desirable to have a recovery system which avoids the manifest problems of the art.

Applicant is not aware of any prior art references which, in his judgment as one skilled in the art of towing seismic subarrays, would anticipate or render obvious the novel recovery method and apparatus of the instant invention.

BRIEF DESCRIPTION OF THE DRAWINGS

FIG. 1 discloses a seismic subarray in a recovered mode suspended alongside a vessel.

FIGS. 2(*a*) and end view 2(*b*) disclose a first step in recovery of the seismic subarray of FIG. 1.

FIGS. 2(*c*) and 2(*d*) show subsequent steps in the recovery process.

FIG. 3 shows a latch mechanism used in the apparatus of FIGS. 2(*a*)–2(*d*).

SUMMARY OF THE INVENTION

Figure 2:
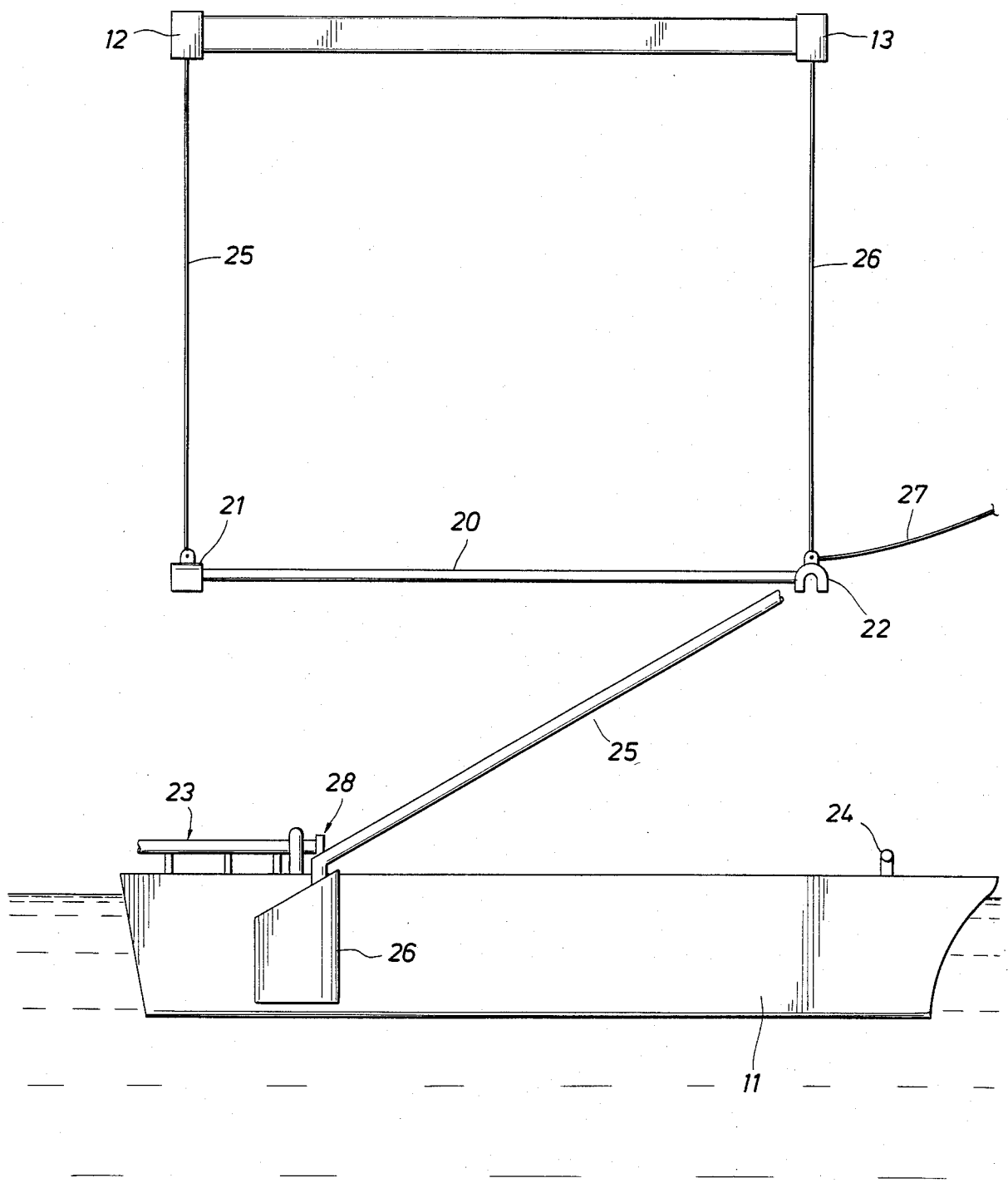
FIG. 2 discloses a side view of the recovery system.
Figure 2A:
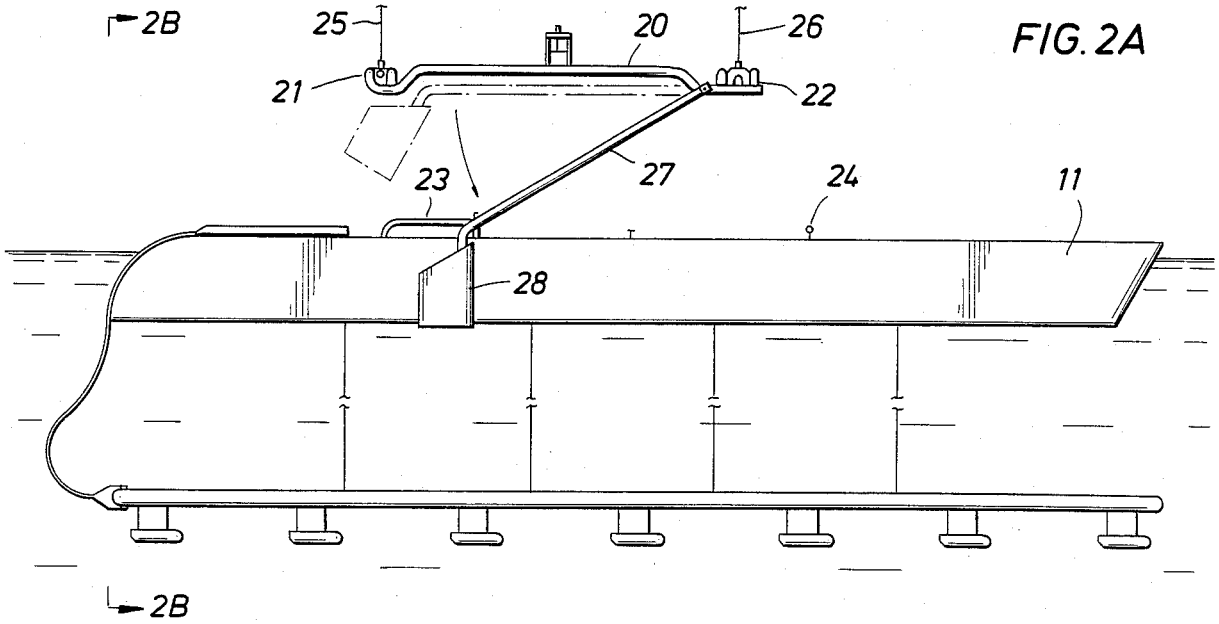
Figure 2B:
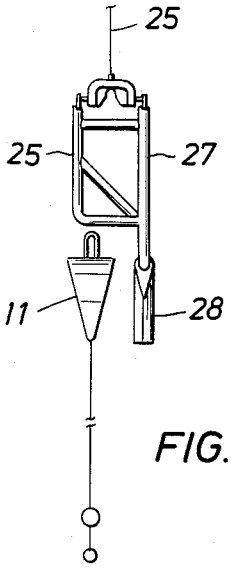
Figure 2C:
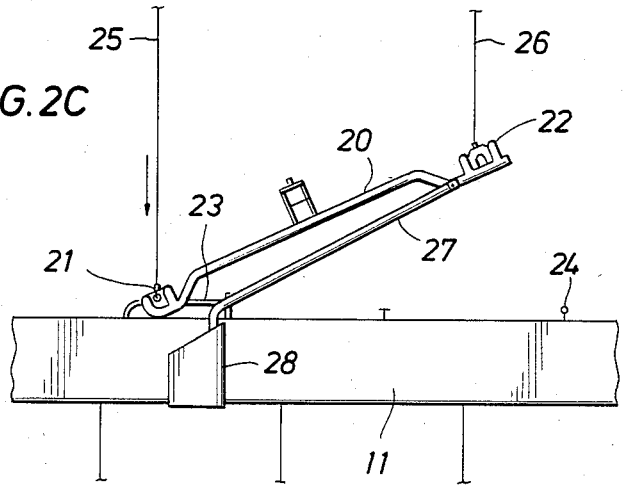
Figure 2D:
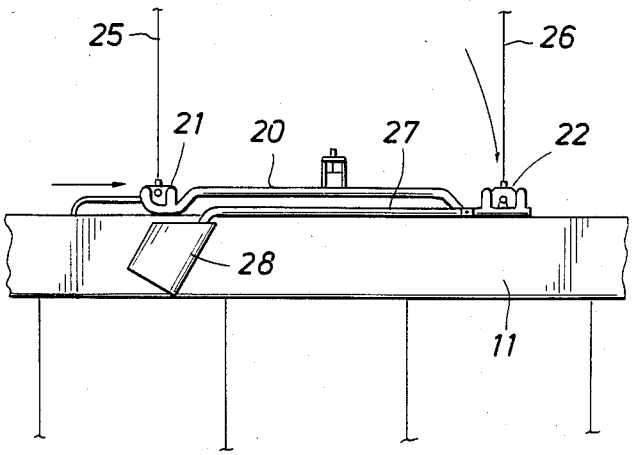

The primary purpose of the present invention is to provide a recovery system for lifting a towed body onboard a towing ship, which system is capable of handling a relatively cumbersome body, which may have attached gear subject to entanglement, and which system is orderly, relatively simple in use, and as free of malfunctioning as possible.

Accordingly, there is provided a method and apparatus for recovering a towed body from the water to onboard a towing ship which is under way, including the steps and means for performing the steps, of positioning the towed body alongside the ship; aligning a saddle means laterally with the towed body; deploying a saddle rudder means attached to the saddle means into the water in the vicinity of the towed body; moving the saddle means in coordination with the saddle rudder means to a position directly above the towed body; and lowering the saddle means into engagement with one end of the towed body. The engaged saddle means preferably is restricted from lateral movement on the towed body by a landing rail but permitted to move longitudinally on the towed body by the extent of the landing rail; the saddle means then is moved longitudinally until one end of the landing rail restricts further longitudinal movement of the saddle means, and the saddle means is lowered into engagement with the other end of the towed body. Preferably, the towed body is a seismic subarray, but it can also be a towed "fish", submarine or a smaller boat, recovered from alongside or from the stern of the mother ship.

Other purposes, advantages and features of the invention will be apparent to one skilled in the art upon review of the following.

DESCRIPTION OF PREFERRED EMBODIMENTS

As shown in FIG. 1, a towing ship or "mother" ship 10 which is underway has a towed body 11 (such as a seismic subarray) which is connected via cables (not shown) to a latching saddle (not shown) from overhead transverse lifting beams 12 and 13. Towed body 11 may be a seismic subarray which is connected to ship 10 by umbilical cable 14 as held outboard of the ship by outrigger support arm 15. Such a subarray may be quite long, e.g. 60 feet, and very heavy, e.g. 25,000 pounds. Once the subarray is launched and towed behind ship 10, recovery of the subarray to the position shown in FIG. 1 is difficult. Accordingly, the following described method and apparatus are directed to solving this problem.

The preferred apparatus for accomplishing this lift job is shown in FIGS. 2(*a*)–2(*b*) which show a spreader beam arrangement 20 that self-latches to the towed body and works like a "saddle", as hereinafter so termed. Self-locking aft latch 21 and forward latch 22 are on either end of saddle 20. These latches grab pipe rails, i.e., aft landing rail 23 and forward rail 24, that are structurally a part of the top of towed body 11 for lifting purposes. Before saddle 20 is lowered from transverse beams 12 and 13 (see FIG. 1) via aft cable 25 and forward cable 26, rudder 28 at the end of a feeler arm 27 is lowered into the water outboard the towed body 11 to be captured (in FIG. 2(*a*) see direction of arrow). Rudder 28 preferably has some effective buoyancy in order to ride near the surface of the water and is inclined to the flow of current (in FIG. 2(*b*) see direction of arrow) so as to cause the feeler arm/rudder combination to "hug" the side of the towed body 11. Use of the feeler arm 27 and rudder 28 gives the operator a true indexing means in lowering the aft end of saddle 20 and aft latch 21 on top of float 11 (in FIG. 2(*c*) see direction of arrow).

The latch 21 (shown in detail in FIG. 3) automatically attaches to landing rail 23 upon contact. Although it is not essential, it is preferred that the forward landing rail 24 be transverse to the longitudinal axis of the towed body 11. Because of this choice, once the aft latch 21 is locked on the aft landing rail 23, the towed body 11 is pulled forward until a "stop" (in FIG. 2(*d*) see left arrow) is contacted on the forward end of the aft landing rail 23. This stop satisfactorily indexes the landing of the forward latch mechanism 22 on the forward landing rail 24 (in FIG. 2(*d*) see right arrow). Once the two latches are engaged and self-latched, the towed vessel 11 may be readily lifted from the water. It is of course feasible to reverse the aft and forward landing rails and/or land the saddle first on the opposite end of the towed body. Also, feeler arm 27 may be movable only in coordination with the saddle, so that the entire end of the saddle is partially lowered in order to get rudder 28 into the water, and then finally lowered in order to engage aft landing rail 23.

Model tests have been performed to demonstrate the feasibility of this method and apparatus in waves to 12 feet in height. A significant feature of the invention is that the saddle 20 can be placed above the wave action while the feeler arm 27 and rudder 28 locate the proper position upon which to lower the aft latch 21. Once the aft latch 21 is engaged, the rest of the attachment may be conducted with relative ease, even in rough weather.

Another significant feature of the invention is the proper weight/buoyancy design of the feeler arm/rudder assembly. Preferably, the assembly has very low reserve buoyancy and a relatively small water plane area in order to make it have a low heave response over the spectrum of normally occurring wave periods. This dynamic response property ensures that the feeler arm-/rudder assembly will not be tossed about in the water by waves, winds and relative water velocities.

Yet another significant feature of the invention resides in the latches 21 and 22 which are preferably spring loaded horseshoe latches which engage by impact on landing rails 23 and 24. As shown in FIG. 3, on either side of each latch are hydraulic cylinders 30 and 31 with built-in springs (not shown) on the rods 32 and 33. The springs preload prawls 34 upon contact (as assisted by the impact force of the saddle 20 landing on rail 23 or 24). Once the rail 23 or 24 moves upward, so as to touch the head of the latch, the prawls 34 spring back in place to close the opening created. The geometry of the latch mechanism is designed so that the landing rail bears against the prawls during the lifting, without subsequent movement of the prawls. The prawls cannot be inadvertently opened by the purposefully undersized hydraulic cylinders without first setting down the towed body in a support structure or "cradle" (to remove the contact pressure on the prawls). This is an inherent safety factor in the invention.

This method and apparatus can be used to lift all forms of towed bodies, like submarines, from alongside or aft of the mother ship.

The foregoing description of the invention is merely intended to be explanatory thereof. Various changes in the details of the described method and apparatus may be made within the scope of the appended claims without departing from the spirit of the invention.

What is claimed is:

1. A method for positioning a towed body for retrieval from the water to onboard a towing ship which is underway, comprising, positioning the towed body adjacent the ship;

aligning a saddle means laterally with the towed body;

deploying a rudder means attached to the saddle means into the water in the vicinity of the towed body;

moving the saddle means in coordination with the rudder to a position directly above the towed body; and lowering the saddle means into engagement with one end of the towed body.

2. An apparatus for positioning a towed body for retrieval from the water to onboard a towing ship which is underway, comprising, saddle means;

rudder means attached via a feeler arm to the saddle and functionable to laterally align the saddle directly above the towed body; and means to engage one end of the saddle means with the towed body and restrict further lateral movement of the saddle means.

3. A method for positioning a seismic subarray of a float, fish and umbilical cable for retrieval from the water to onboard a towing ship which is underway, comprising, positioning the subarray adjacent the ship;

aligning a saddle means with the float of the subarray;

deploying a rudder means attached to the saddle means into the water in the vicinity of the float;

moving the saddle means in coordination with the rudder to a position directly above the float; and lowering the saddle means into engagement with a landing rail on the float.

4. An apparatus for positioning a seismic subarray of a float, gun support beam and umbilical cable for retrieval from the water to onboard a towing ship which is underway, comprising, saddle means;

rudder means attached to the saddle and functionable to laterally align the saddle with the float; and a landing rail on the float which is operative to engage the saddle means and restrict further lateral movement of the saddle means.

5. A method for positioning a towed body for retrieval from the water to onboard a towing ship which is underway, comprising, positioning the towed body adjacent the ship;

aligning a saddle means laterally with the towed body;

deploying a rudder means attached to the saddle means into the water in the vicinity of the towed body;

moving the saddle means in coordination with the rudder to a position directly above the towed body; and lowering the saddle means into engagement with one end of the towed body, the engaged saddle means being restricted from lateral movement on the towed body by an aft landing rail but permitted to move longitudinally on the towed body by the extent of the aft landing rail.

6. The method of claim 5 wherein the saddle means is moved longitudinally until one end of the aft landing rail restricts further longitudinal movement of the saddle means, whereupon the saddle means is lowered and engaged with a forward landing rail at the other end of the towed body.

7. An apparatus for positioning a towed body for retrieval from the water to onboard a towing ship which is underway, comprising, saddle means;

rudder means attached via a feeler arm to the saddle and functionable to laterally align the saddle with the towed body;

means to engage one end of the saddle means with the towed body and restrict further lateral movement of the saddle means; and means for moving the saddle means longitudinally on the towed body into engagement with a lifting rail at the other end of the towed body.

8. A method for positioning a seismic subarray of a float, fish and umbilical cable for retrieval from the water to onboard a towing ship which is underway, comprising, positioning the subarray adjacent the ship;

aligning a saddle means with the float of the subarray;

deploying a rudder means attached to the saddle means into the water in the vicinity of the float, a feeler arm being employed to position the rudder alongside the float;

moving the saddle means in coordination with the rudder to a position directly above the float; and lowering the saddle means into engagement with a landing rail on the float.

9. A method for positioning a seismic subarray of a float, fish and umbilical cable for retrieval from the water to onboard a towing ship which is underway, comprising, positioning the subarray adjacent the ship;

aligning a saddle means with the float of the subarray;

deploying a rudder means attached to the saddle means into the water in the vicinity of the float;

moving the saddle means in coordination with the rudder to a position directly above the float; and lowering the saddle means into engagement with a landing rail on the float, the engaged saddle means being restricted from lateral movement on the float but permitted to move longitudinally along the landing rail.

10. The method of claim 9 wherein the saddle means is moved longitudinally until contact with a stop restricts further longitudinal movement of the saddle means, whereupon the other end of the saddle means is engaged with the other end of the subarray.

11. An apparatus for positioning a seismic subarray of a float, gun support beam and umbilical cable for retrieval from the water to onboard a towing ship which is underway, comprising, saddle means;

rudder means attached to the saddle and functionable to laterally align the saddle with the float and including a feeler arm operative to position the rudder means alongside the float; and a landing rail on the float which is operative to engage the saddle means and restrict further lateral movement of the saddle means.

12. The apparatus of claim 11 including means for moving the saddle longitudinally along the float into engagement with a forward lifting rail which is functionable to prevent further longitudinal movement of the saddle.

13. An apparatus for positioning a seismic subarray of a float, gun support beam and umbilical cable for retrieval from the water to on-board a towing ship which is underway, comprising, saddle means;

rudder means attached to the saddle and functionable to laterally align the saddle with the float; and a landing rail on the float which is operative to engage the saddle means and restrict further lateral movement of the saddle means, the landing rail being operative to restrict the saddle means from lateral movement but permit longitudinal movement with respect to the float.

14. The apparatus of claim 13 including means for moving the saddle longitudinally along the float into engagement with a forward lifting rail which is functionable to prevent further longitudinal movement of the saddle.

* * * * *